United States Patent [19]

Matsumi et al.

[11] Patent Number: 5,048,139

[45] Date of Patent: Sep. 17, 1991

[54] WASHING MACHINE WITH A TURBIDIMETER AND METHOD OF OPERATING SAME

[75] Inventors: Takatomo Matsumi, Fujiidera; Kazutoshi Takimotò, Yao; Koji Kikuchi, Osaka, all of Japan

[73] Assignee: Sharp Kabushiki Kaisha, Osaka, Japan

[21] Appl. No.: 552,705

[22] Filed: Jul. 16, 1990

Related U.S. Application Data

[63] Continuation of Ser. No. 40,751, Apr. 20, 1987, abandoned, which is a continuation-in-part of Ser. No. 782,022, Oct. 23, 1985, abandoned.

[30] Foreign Application Priority Data

| | | | |
|---|---|---|---|
| Jan. 8, 1985 | [JP] | Japan | 60-1834 |
| Jan. 8, 1985 | [JP] | Japan | 60-1835 |
| Jan. 8, 1985 | [JP] | Japan | 60-1837 |
| Jan. 8, 1985 | [JP] | Japan | 60-1838 |
| Jan. 9, 1985 | [JP] | Japan | 60-2795 |
| Jan. 9, 1985 | [JP] | Japan | 60-2799 |
| Feb. 5, 1985 | [JP] | Japan | 60-21500 |

[51] Int. Cl.[5] ..... D06F 33/02; D06F 39/00

[52] U.S. Cl. ..... 8/158; 68/12.02; 68/12.12; 68/12.27

[58] Field of Search ..... 68/12 R, 13 R, 207, 68/12.02, 12.12, 12.27; 134/57 D, 113; 8/158; 356/433-436, 440-442

[56] References Cited

U.S. PATENT DOCUMENTS

| | | | |
|---|---|---|---|
| 4,222,250 | 9/1980 | Torita | 68/12 R |
| 4,237,565 | 12/1980 | Torita et al. | 68/12 R X |
| 4,257,708 | 3/1981 | Fukuda | 68/12 R X |

FOREIGN PATENT DOCUMENTS

| | | | |
|---|---|---|---|
| 30675 | 3/1979 | Japan | 68/12 R |
| 141990 | 8/1984 | Japan | 68/12 R |
| 2068419 | 8/1981 | United Kingdom | 68/12 R |

*Primary Examiner*—Philip R. Coe
*Attorney, Agent, or Firm*—Irell & Manella

[57] ABSTRACT

A washing machine uses a turbidimeter to measure turbidity of cleaning water for controlling the duration of its washing and cleaning cycles. Quality of this control is improved by taking measurements when the water flow is weak so that the effects of foams are negligible and waiting until turbidity drops at the beginning of the cycle to detect the initial value used in subsequent steps. Sensitivity of the turbidimeter is automatically adjusted for accuracy when the operation is temporarily stopped and restarted during a cycle.

13 Claims, 6 Drawing Sheets

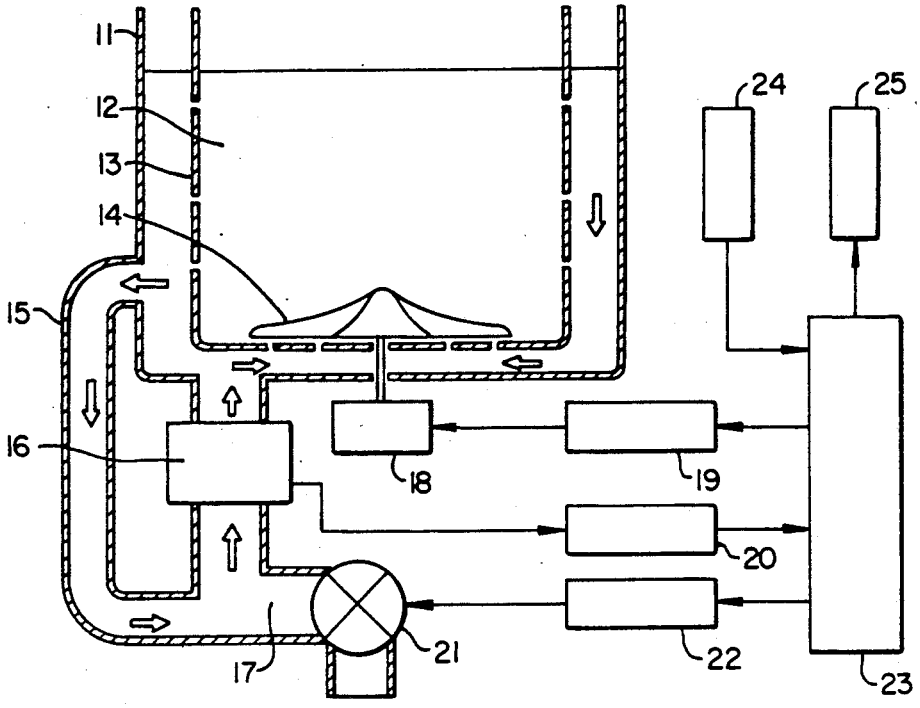
FIG._1.
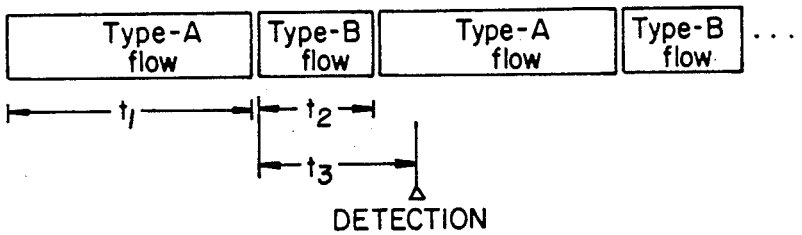
FIG._2.
| FLOW | CW | OFF | CCW | OFF |
|---|---|---|---|---|
| TYPE-A | $t_4$ | $t_5$ | $t_6$ | $t_7$ |
| TYPE-B | $t_8$ ($< t_9$) | $t_9$ ($> t_5$) | $t_{10}$ ($< t_6$) | $t_{11}$ ($> t_7$) |
FIG._3.
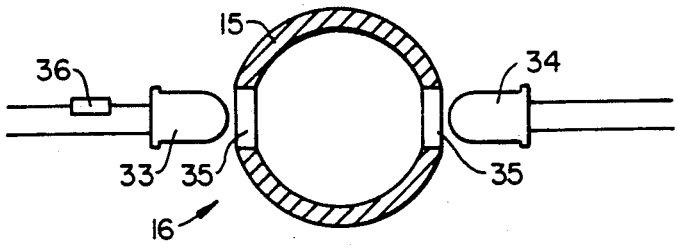
FIG._4.

WASHING MACHINE WITH A TURBIDIMETER AND METHOD OF OPERATING SAME

This is a continuation of application Ser. No. 040,751 filed Apr. 20, 1987, now abandoned, which is a continuation of application Ser. No. 782,022 filed Oct. 23, 1985, now abandoned.

This invention relates to a washing machine with an optical turbidimeter and methods of controlling washing and rinsing cycles in the operation of such a washing machine.

The optical turbidimeter is a sensor for measuring turbidity by optical means including a photodetector and a washing machine equipped with such a device is adapted to be operated by determining the end of its washing and rinsing cycles on the basis of measured turbidity level of its cleaning water. As will be described below more specifically, however, conventional washing machines of this type have required improvements in many aspects. For example, undissolved detergent particles and foams can affect the reliability of results obtained by the turbidimeter, and hence the appropriateness of the time selected to end a washing or rinsing cycle.

As another example, British Patent 2,068,419 discloses a washing machine with a transparency detector, the output signal from which is compared with a reference signal during pause periods of its pulsator. This is because the detector is at the bottom of the washing machine and foams and particles reach the neighborhood of the detector instantly by responding to the motion of the pulsator, but experiments have shown that foams gather excessively and that turbidity of the washing water cannot be detected with sufficient accuracy.

It is therefore one object of the present invention to provide a washing machine with a turbidimeter which is capable of accurately measuring turbidity of cleaning water so as to improve its efficiency.

Another object of the present invention is to provide a washing machine with a turbidimeter which can be adjusted with respect to the control circuit of the washing machine without requiring expensive means.

Another object of the present invention is to provide a method of and means for controlling a washing machine with a turbidimeter so that the time to end a washing and rinsing cycle can be reliably determined.

Another object of the present invention is to provide a washing machine with a turbidimeter which can be temporarily stopped and restarted during a washing cycle without adversely affecting its ability to correctly determine the time to end the cycle.

Another object of the present invention is to provide a washing machine with a turbidimeter which includes a reliable warning system for identifying a failure in a turbidimeter.

Still another object of the present invention is to provide a washing machine with a turbidimeter capable of preventing insufficient o excessive rinsing.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

In general, the present invention relates to a washing machine with a turbidimeter which can achieve the above and other objects. In one aspect of the present invention, a washing machine of this type is adapted to alternately execute a strong flow operation and a weak flow operation so that its turbidimeter can measure turbidity of its cleaning water when foams are not likely to be present in the neighborhood of the turbidimeter. In another aspect of the present invention, an adjustable resister is provided to either the light-emitting element or the light-receiving element of the turbidimeter so that the individual fluctuation of the turbidimeter (say, from the manufacturing process) can be expeditiously corrected. In still another aspect of the present invention, the effects of undissolved detergent particles and residual foams present at the beginning of a washing or rinsing cycle are avoided by considering as initial turbidity value of the cycle not the turbidity measured at the very beginning of the cycle but the value obtained at a somewhat later time when the effects of residual foams, etc. disappear. In order to allow the operation to be stopped temporarily and started again during a cycle, an extra means is provided to automatically adjust the sensitivity of the turbidimeter according to the turbidity level at the restarting time.

In a further aspect of the present invention, a warning system is provided to the washing machine adapted to detect a failure by considering an abnormally high turbidity level as a sign of failure but this is done not during a washing cycle but only during a rinsing cycle. In a still further aspect of the present invention, excess rinsing and insufficient rinsing are avoided by computing the average of initial and final turbidity values during a rinsing cycle and comparing this average with a reference value. If rinsing is required for the second time, the second rinsing cycle is carried out similarly but the reference value used for the second rinsing cycle is made larger than that for the first cycle.

The accompanying drawings, which are incorporated in and form a part of the specification, illustrate the present invention by way of several embodiments.

FIG. 1 is a block diagram of a control system for a washing machine according to one embodiment of the present invention.

FIG. 2 is a diagram showing the pattern of water flow in the washing machine of FIG. 1.

FIG. 3 is a diagram showing the operation of a pulsator motor for the washing machine of FIG. 1 generating a flow pattern of FIG. 2.

FIG. 4 is a schematic drawing for showing the structure of a turbidimeter according to one embodiment of the present invention.

Figure 5:
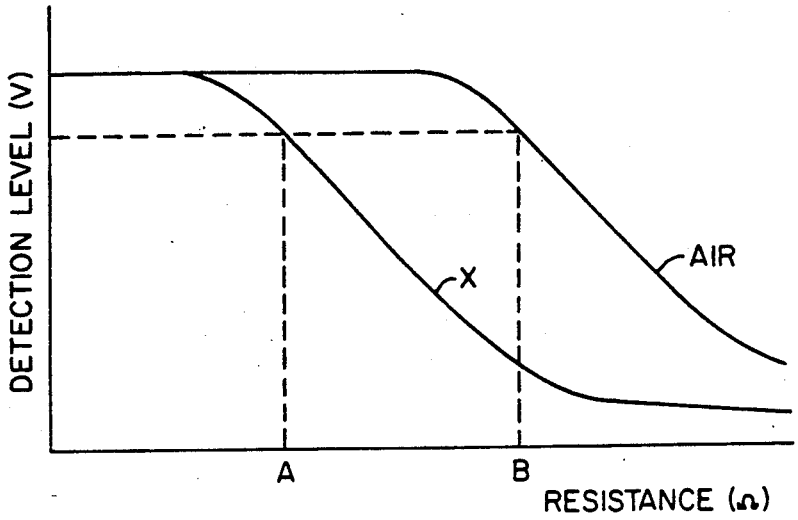
FIG. 5 is a graph schematically showing the relationship between a resister for adjustment and the detection level of a light-receiving element used in the control system of FIG. 1.

FIG. 1 is a block diagram of a control system for a washing machine according to one embodiment of the present invention, showing an outer tank 11 adapted to store cleaning (washing and/or rinsing) water 12, an inner tank 13 which functions both as a washing tank and as a draining tank, a pulsator 14 disposed at the bottom inside the inner tank 13, and a circulation route 15 for the cleaning water with one end opening on a bottom side surface of the outer tank 11 and the other end opening on the bottom surface thereof. An optical turbidimeter 16 is inserted in the circulation route 15 and is adapted to optically measure changes in the turbidity of the cleaning water 12 by means of a light-emitting element and a light-receiving element. A draining route 17 is connected to the circulation route 15 for draining the cleaning water 12 out of the outer tank 11. The pulsator 14 is driven by a motor 18 having a motor-control means 19 for switching the motor 18 on and off. Numeral 20 indicates a turbidity detecting means having a memory means for storing data outputted by the turbidimeter 16 and indicative of values detected thereby, a computing means for computing temporal rate of change in the detected values, a decision-making means for determining the end of an operation cycle when the rate of change in the detected value becomes smaller than a given value, and a sensitivity adjusting means for adjusting the sensitivity of the turbidimeter 16. Numeral 21 indicates a drain valve inserted in the draining route 17, numeral 22 indicates a drain valve control means for controlling the drain valve 21 and numeral 23 indicates a sequence control means such as a microcomputer to control the individual means according to a given program. Numeral 24 indicates a temporary stop means and numeral 25 indicates a warning means comprising a lamp and a buzzer.

The sequence control means 23 is programmed to drive the motor 18 through the motor control means 19 to cause the pulsator 14 to execute a reciprocating angular motion to produce a reciprocating water flow. According to an embodiment of the present invention, the sequence control means 23 is programmed to alternately produce a strong reciprocating flow (hereinafter referred to as a type-A flow) of duration $t_1$ and a weak reciprocating flow (hereinafter referred to as a type-B flow) of duration $t_2$ (where $t_1$ is greater than $t_2$) as shown in FIG. 2. In order to produce type-A and type-B flows alternately as shown in FIG. 2, the motor 18 is switched on for a clockwise (CW) rotation for a duration of $t_4$, off for $t_5$, on for a counter-clockwise (CCW) rotation for $t_6$ and off for $t_7$ for each strong flow operation cycle to produce a type-A flow, and on for a clockwise rotation for a duration of $t_8$ (smaller than $t_4$), off for $t_9$ (greater than $t_5$), on for a counter-clockwise rotation for $t_{10}$ (smaller than $t_6$) and off for $t_{11}$ (greater than $t_7$) for each weak flow operation cycle to produce a type-B flow as shown in FIG. 3.

When the pulsator 14 is rotated, not only is the cleaning water inside the inner tank 13 forcibly agitated but a portion of the cleaning water is caused to circulate as shown by arrows in FIG. 1 from the inner tank 13 to the outer tank 11, to the circulation route 15 (and through the turbidimeter 16), and back to the inner tank 13 through the holes at the bottom of the outer tank 11. During a strong flow operation cycle creating a type-A flow, foams are generated more vigorously because the motor 18 remains in the on-condition for a long period. Such foams are pulled into the circulation route 15 and may even reach the turbidimeter 16 if the motor 18 remains in the on-condition for a sufficiently long period. During a weak flow operation cycle creating a type-B flow, by contrast, foams are not generated so much because the flow is not strong. Generated foams may be pulled into the circulation route 15 but since the motor 18 does not remain in the on-condition for a long time, the next off-period sets in before the foams can reach the turbidimeter 16. Such foams left inside the circulation route 15 flow back by their own buoyancy and return to the outer tank 11 without reaching the turbidimeter 16.

As mentioned above, one of the objects of the present invention is to provide a washing machine with a turbidimeter capable of accurately measuring the turbidity of cleaning water. In view of the considerations given above and since the accuracy of control can be improved by eliminating the effects of foams in the neighborhood of the turbidimeter, the control system of the present invention is characterized in that turbidity is measured by selecting times when there are no foams inside the turbidimeter 16 and that measurements are taken only at such times. Reference being made again to FIG. 2, the sequence control means 23 is programmed to cause the turbidity detecting means 20 to measure the turbidity inside the turbidimeter 16 at a preselected time interval $t_3$ after the beginning of each weak flow operation cycle (producing a type-B flow), regulating the end of a washing or rinsing cycle on the basis of such turbidity measurement. Since the effects of the immediately preceding strong flow operation cycle usually remain in the beginning of a weak flow operation cycle, it is preferable to conduct such a turbidity measurement when stability is optimum between the final phase of a weak flow operation cycle and the beginning of the subsequent strong flow operation cycle (as shown in FIG. 2). According to an experiment where a washing machine was operated with $t_1=26$ sec, $t_2=6.5$ sec, $t_4=t_6=1.4$ sec, $t_5=t_7=0.6$ sec, $t_8=t_{10}=0.8$ sec and $t_9=t_{11}=1.6$ sec, a favorable result was obtained with a choice of $t_3=13$ sec.

In summary, a strong flow and a weak flow are produced alternately in order to correctly measure the turbidity of the cleaning water without lengthening the on-period or shortening the off-period of the motor throughout the operation to eliminate the effects of foams. This means that accuracy of control can be improved without adversely affecting the washing efficiency.

FIG. 4 is a schematic drawing for showing the structure of the turbidimeter 16 according to one embodiment of the present invention. Viewed cross-sectionally, the turbidimeter 16 according to this embodiment includes a light-emitting element 33 and a light-receiving element 34 disposed across the circulation route 15 and facing transparent windows 35 provided on opposite walls of the circulation route 15. Numeral 36 indicates an adjustable resistor.

In general, fluctuations in the characteristics of light-emitting and light-receiving elements as manufactured products contribute to the fluctuations in the detection characteristics such as sensitivity of turbidimeters. For this reason, whenever a turbidimeter is installed in a washing machine, various expensive means have been considered to matchingly coordinate the turbidimeter and the control circuit of the washing machine. As stated above, one of the objects of the present invention is to provide a washing machine with an inexpensive means for matchingly adjust its control circuit to the turbidimeter and this object is achieved by means of the adjustable resistor 36.

Explained more in detail, the turbidimeter is adjusted initially when it is assembled as a completed instrument by causing the light-emitting element 33 to emit light through the windows 35. The level detected by the light-receiving element is measured and the resistor 36 is adjusted until the detected level matches a desired value. In short, since the adjustment is carried out by means of the resistor 36 which forms a part of the turbidimeter 16, the control circuit for the washing machine need not include means for matching it with the turbidimeter 16. This contributes to the reduction in overall price of the control system.

Figure 6:
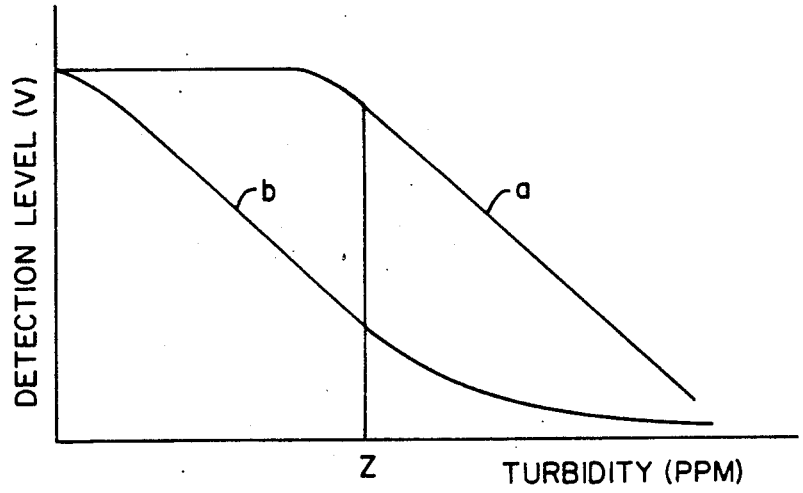
FIG. 6 is a graph schematically showing the relationship between turbidity of cleaning water and the detection level of the light-receiving element in the control system of FIG. 1.

Next, a method of making actual adjustment is explained by way of FIG. 5 which schematically shows the relationship between the resistor 36 and the detection level of the light-receiving element 34. Reference being made to FIG. 5, the curve "AIR" shows the characteristic when the interior of the circulation route 15 is air and the curve "X" shows the characteristic when the circulation route 15 is filled with cleaning water. Let us assume first that the resistor 36, when adjusted with the circulation route 15 filled with cleaning water at the beginning of a washing cycle, has resistance A as shown in FIG. 5. FIG. 6 is a graph schematically showing the relationship between turbidity and the detection level of the light-receiving element 34 and the curve "a" therein represents the relationship when the resistor 36 has resistance A. According to FIG. 6, therefore, turbidity at this moment at the beginning of a washing cycle is Z. As the washing cycle progresses, turbidity increases and the detection level of the light-receiving element 34 drops as shown by the curve "a" in FIG. 6.

Let us assume next for comparison that the resistor 36 is adjusted when the circulation route 15 is filled with air so as to have B as its resistance as shown in FIG. 5. Reference being made next to FIG. 6, the curve "b" represents the relationship between turbidity and the detection level of the light-receiving element 34 when the resistance of the resistor 36 is B. In this situation, as the washing cycle progresses and turbidity increases from its initial value Z, the change in the detection level of the light-receiving element 34 is extremely small and it is difficult to accurately measure the variations in turbidity. Accordingly, it is necessary to fill the circulation route 15 with cleaning water or to insert therein a filter having turbidity of a comparable level when the resistance of the resistor 36 is adjusted. It is extremely troublesome, however, to fill the circulating route 15 with cleaning water or to insert a filter therein for testing each turbidimeter. Moreover, fluctuations can result easily depending on how the turbidimeter is placed inside the circulation route.

With turbidimeters of the present invention, on the other hand, a reference unit is used first to determine values A and B respectively when the circulation route is filled with cleaning water and air. Next, the resistor 36 of a turbidimeter to be adjusted is varied so that the detection level of its light-receiving element 34 in an air-filled condition is determined. If this value is B' (which may not be equal to B), a resistor with resistance given by $B'-(B-A)$ is used with this turbidimeter. In other words, it is only regarding one reference turbidimeter that measurements are taken both in air-filled and water-filled conditions to obtain two measured values A and B. Regarding the other turbidimeters, measurements are taken only in an air-filled condition, and the values A and B obtained with the aforementioned referenced turbidimeter are used with such measured values to estimate the correct values of resistance for the individual turbidimeters. In summary, the turbidimeter according to the present invention can be adjusted without the troublesome operation of filling the circulation route with water or inserting a filter therein for each unit. It goes without saying that adjustments may instead be carried out by using clean water instead of cleaning water in the procedure described above. It also goes without saying that the resistor 36 may be connected to the light-receiving element 34 instead of to the light-emitting element 33 as shown in FIG. 4, or that two resistors may be used, each connected to one of the elements.

Figure 7:
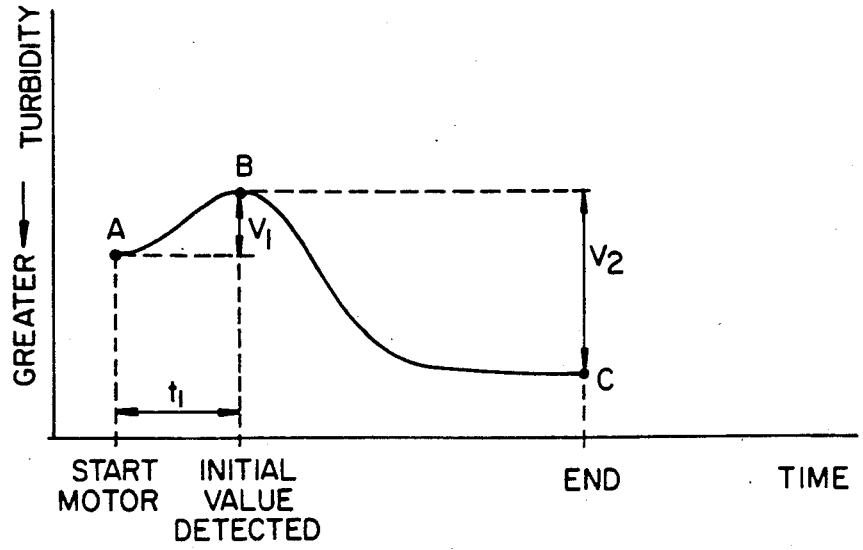
FIG. 7 is a typical graph showing the time rate of change in turbidity of cleaning water.

As mentioned briefly above, turbidity of cleaning water detected by the turbidimeter 16 generally changes rapidly during a beginning period in a washing cycle, the change becoming gradually smaller as time goes on. Prior to a washing cycle, however, undissolved detergent particles are often stagnating at the bottom of the tank so that turbidity near the turbidimeter 16 is large when the motor 18 is started. At the beginning of a rinsing cycle, likewise, the detected level of turbidity is high when the motor 18 is started for rinsing because the left-over detergent and foams after the cleaning water has been drained tend to gather near the turbidimeter 16 even after the drain valve 21 is closed. Thus, the change in turbidity in a cycle (such as a washing cycle) may typically look as shown in the graph of FIG. 7. Accordingly, the determination of the end of a cycle (washing or rinsing) on the basis of the temporal rate of change in turbidity would be faulty, if the level of turbidity at the time of starting the motor 18 is used as initial value to be referenced. An idea has been presented according to which the initial value to be referenced be determined a specified time period after the motor is started. This idea is not useful when liquid detergent is used because there is no precipitation and there is no need to wait. In the case of rinsing after a washing cycle in which only a very small amount of detergent was used, furthermore, the effects of foams, etc. are negligibly small and it is not necessary to wait for a fixed period of time before an initial value is considered.

Figure 8:
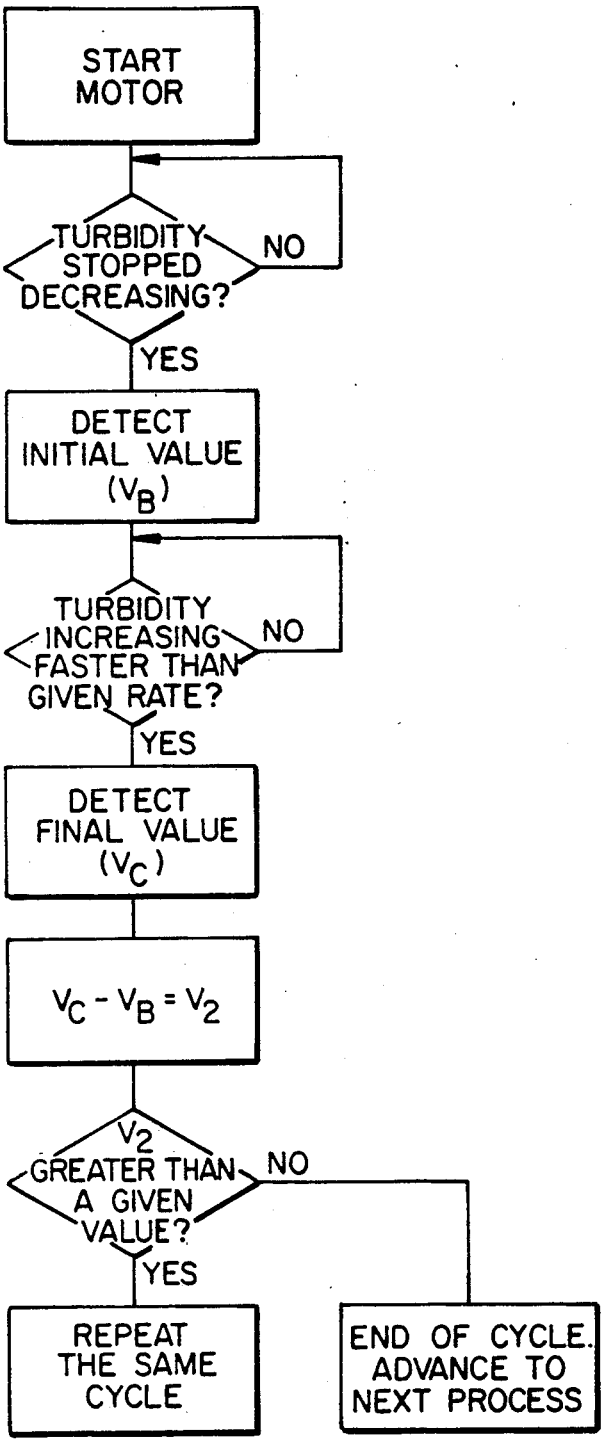
FIG. 8 is a flow chart for a control system according to the present invention.

FIG. 8 is a flow chart for a control system according to one embodiment of the present invention. When the motor 18 is started at the beginning of a cycle, the detected level of turbidity is shown by the point A in FIG. 7. As explained above, turbidity at the point A is rather high due to the left-over detergent particles and foams stagnating at the bottom. When the motor 18 is started, cleaning water begins to circulate through the circulation route 15 and the water density becomes uniform throughout. Thus, the detected turbidity level becomes smaller for an initial period of time shown by $t_1$ in FIG. 7.

Eventually, dirt particles contained in articles to be washed begin to appear in the case of a washing cycle and the detergent particles hidden in the articles to be washed begin to appear in the case of a rinsing cycle, increasing the turbidity level again. This turning point is identified by the point B in FIG. 7. According to the flow chart of FIG. 8, the turbidity detecting means 20 keeps monitoring the decrease in turbidity and, when it identifies the point B, stores the value of turbidity $V_B$ at this point to be used as initial value in the subsequent steps. The rate of change in turbidity decreases as time elapses as explained above. When the computed rate of change in turbidity with respect to time becomes below a predetermined value, it is identified as the end of the cycle shown by the point C in FIG. 7. The difference in turbidity $V_1$ between the points A and B and that $V_2$ between the points B and C are computed. If $V_2$ is greater than a predetermined value in the case of a washing cycle, it is interpreted that more washing is necessary. In the case of a rinsing cycle, it is similarly interpreted that more rinsing is necessary. A corresponding signal is then transmitted to the sequence control means 23 to that effect. The aforementioned time interval $t_1$ and the value $V_1$ vary, depending on the type and quantity of detergent being used, the quantity and characteristics of the articles being washed, the amount of water and the rate of flow. Many kinds of liquid detergent do not affect turbidity and in such a situation, $V_1$ is nearly zero and $t_1$ is the detection interval of the turbidimeter 16. Similarly, $V_1$ is nearly zero in a rinsing cycle when only a small amount of detergent has been used for washing or if it is a second or third rinsing cycle. In short, the control system of the present invention is adapted to automatically adjust the initial turbidity value by monitoring its rate of change instead blindly accepting the value detected at the very beginning of the cycle so that the end of the cycle can be identified more reliably by ignoring the effects of leftover detergent particles and foams.

Figure 9:
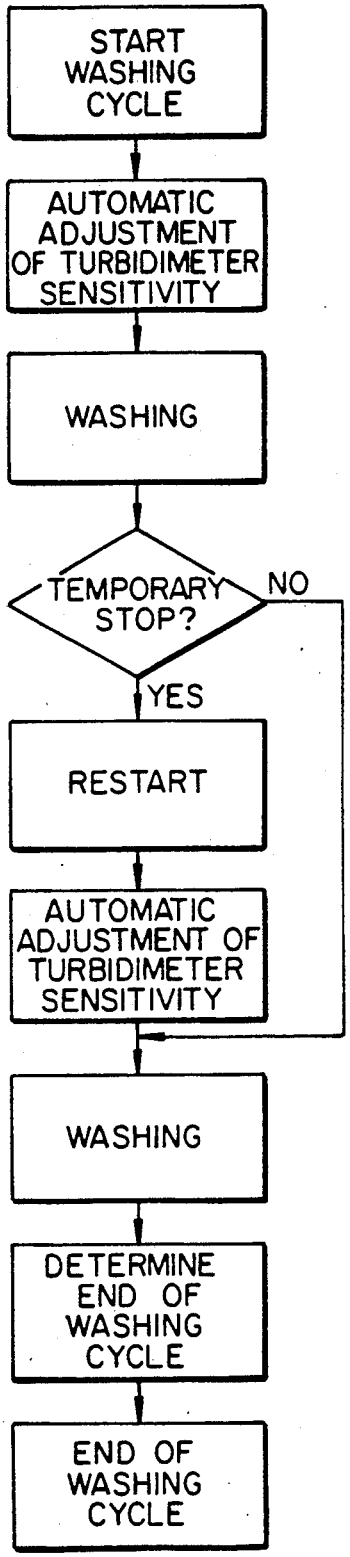
FIG. 9 is a flow chart for explaining the operation of temporary stop means.

Reference being made again to FIG. 1, numeral 24 indicates a temporary stop means for allowing the operation of the washing machine to be temporarily stopped during a washing cycle, for example, for throwing in an extra batch of clothing to be washed. With a conventional washing machine without this feature, if the operation is temporarily stopped during a washing cycle and then started again, the sensitivity of the turbidimeter is not readjusted and hence the end of the washing cycle cannot be accurately detected. One of the objects of the present invention is to provide a washing machine with a turbidimeter which can automatically adjust the sensitivity of its turbidimeter not only at the beginning of a washing cycle but also when its operation is temporarily stopped and then restarted during a washing cycle. This is achieved by means of the temporary stop means 24 and its operation is explained below by way of an operation flow chart of FIG. 9.

When articles to be washed are put inside the inner tank 13 and the motor 18 is started to initiate a washing cycle, the sensitivity of the turbidimeter 16 is automatically adjusted according to the turbidity level of the cleaning water at that point in time and the cycle continues until the temporal rate of change in turbidity detected by the turbidimeter is below a certain level as explained above. If a stop signal is inputted during such a cycle from the temporary stop means 24, the sequence control means 23 immediately interrupts the washing operation. When the operation is resumed, for example, after an extra batch of clothing is thrown in, the temporary stop means 24 functions so as to automatically readjust the sensitivity of the turbidimeter 16 according to the turbidity level of the cleaning water at this point in time. Accordingly the control system can thereafter correctly evaluate the rate of change in turbidity of the cleaning water and determine the end of the washing cycle.

Reference being made once again to FIG. 1, numeral 25 indicates a warning means comprising a lamp and a buzzer by means of which warning signals are adapted to be outputted in response to a signal from the sequence control means 23.

The output from a turbidimeter, when there is a failure therein, generally resembles that when the turbidity being measured is very high. Since the turbidity of cleaning water becomes very high when greasy, muddy or otherwise very dirty articles are being washed, there would be false alarms if the warning system for the washing machine entirely depended on the level of turbidity in identifying a failure. It is therefore one of the objects of the present invention, as stated above, to prevent the occurrence of false alarms corresponding to a high turbidity level. This object is herein achieved by providing a new type of warning system which examines only during a rinsing cycle whether the turbidity level detected by the turbidimeter is greater than a predetermined value to identify the presence of a failure in the turbidimeter.

Figure 10:
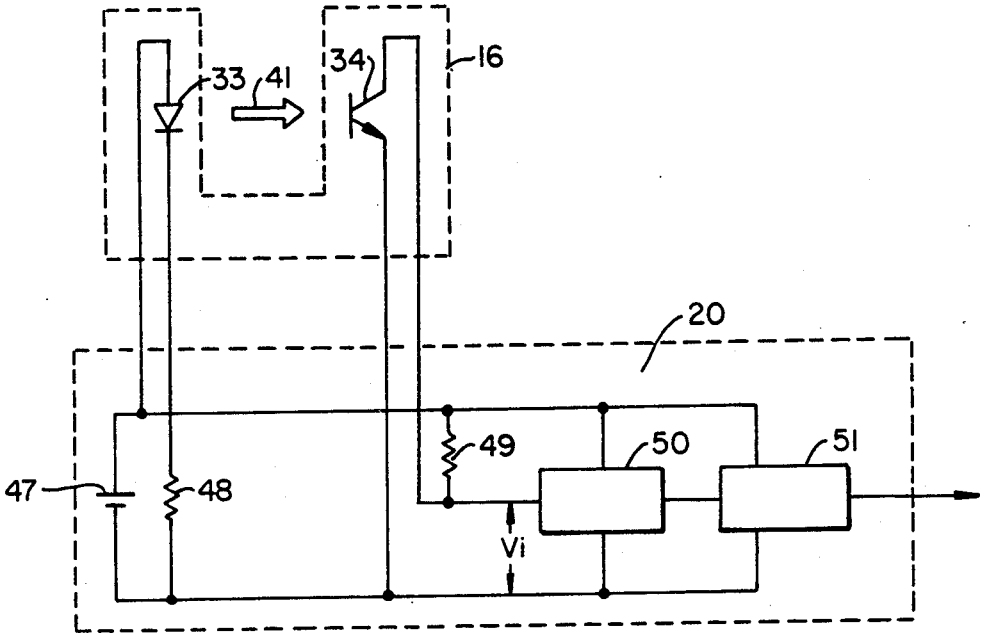
FIG. 10 is a structural diagram for a warning system.

FIG. 10 is a structural diagram for a warning system according to one embodiment of the present invention. Numerals 16 and 20, as used in FIG. 1, again indicate respectively the turbidimeter and the turbidity detecting means, the turbidimeter 16 including a light-emitting element 33 and a light-receiving element 34 as shown in FIG. 4 and numeral 41 indicating a light beam transmitted form the light-emitting element 33 through the circulating cleaning water to the light-receiving element 34. As for the turbidity detecting means 20, numeral 47 indicates a power source, numeral 48 indicates a resister for limiting the intensity of light from the light-emitting element 33, numeral 49 is a resistor for adjusting the photosensitivity of the light-receiving element 34, numeral 50 is an analog-to-digital conversion circuit, and numeral 51 is a logic circuit. When the amount of light transmitted through the turbidimeter 16 changes due to a variation in turbidity, the analog voltage value $V_i$ inputted to the analog-to-digital conversion circuit also changes. Generally, $V_i$ is small when detected turbidity is small and $V_i$ increases uniformly as turbidity becomes larger. Thus, when the light-emitting element 33 fails or when the light-receiving element 34 has a failure other than a short circuit, detected turbidity is large and hence $V_i$ is large. If there is a short circuit in the light-receiving element 34, however, it appears as if turbidity is small. On the other hand, turbidity becomes high when very dirty clothes are washed to make the cleaning water black. This means that the warning system would function dependably in detecting a failure in the turbidimeter 16 during a washing cycle only if the failure is in the light-emitting element 33 or is other than a short circuit in the light-receiving element 34. Such failures, however, can always be detected dependably during a rinsing cycle. According to the present invention, therefore, the sequence control means 23 checks whether the washing machine is in a washing cycle or in a rinsing cycle when the turbidity detecting means 20 finds that the detected turbidity level is higher than a predetermined value and sends to the sequence control means 23 a message signal to that effect, not activating the warning means 25 if it is in a washing cycle but causing an alarm to be outputted by activating the warning means 25 if it is found to be in a rinsing cycle. In summary, even though very dirty clothes are washed and the turbidity of the cleaning water exceeds a predetermined maximum level during a washing cycle, the warning means 25 is not activated and a false alarm is not outputted.

The warning system of the present invention is further adapted to activate the warning means 25 whether it is during a washing cycle or a rinsing cycle if the detected turbidity level is lower than a predetermined minimum level.

Figure 11:
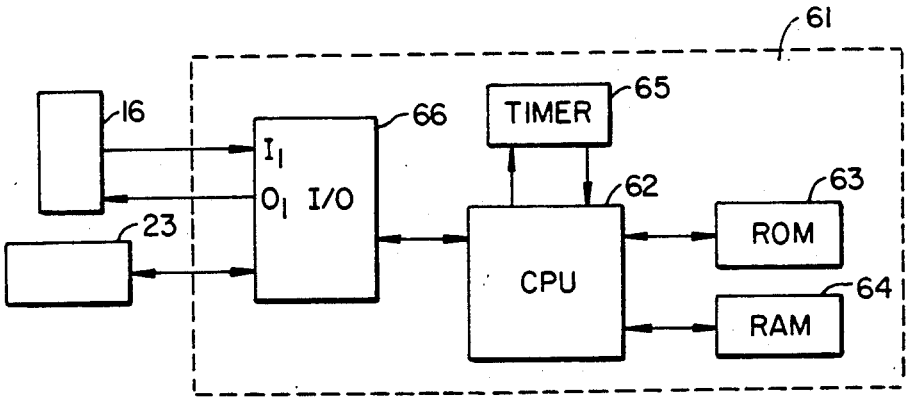
FIG. 11 is a block diagram of a control circuit embodying the present invention for controlling the washing and rinsing cycles.

When the batch of articles thrown in for washing includes both an easily cleanable type and a hard-to-clean type, the ends of washing and rinsing cycles should not be identified merely by the measured rate of change in turbidity of the cleaning water which becomes less than a predetermined minimum value. This is because the temporal rate of change in turbidity is small in the case of a hard-to-clean article and washing cycles may be prematurely terminated. FIG. 11 is a block diagram of a control circuit 61 according to the present invention for more correctly controlling the washing and rinsing operation by measuring the turbidity level of the cleaning water even if the temporal rate of change therein may be small.

Figure 13:
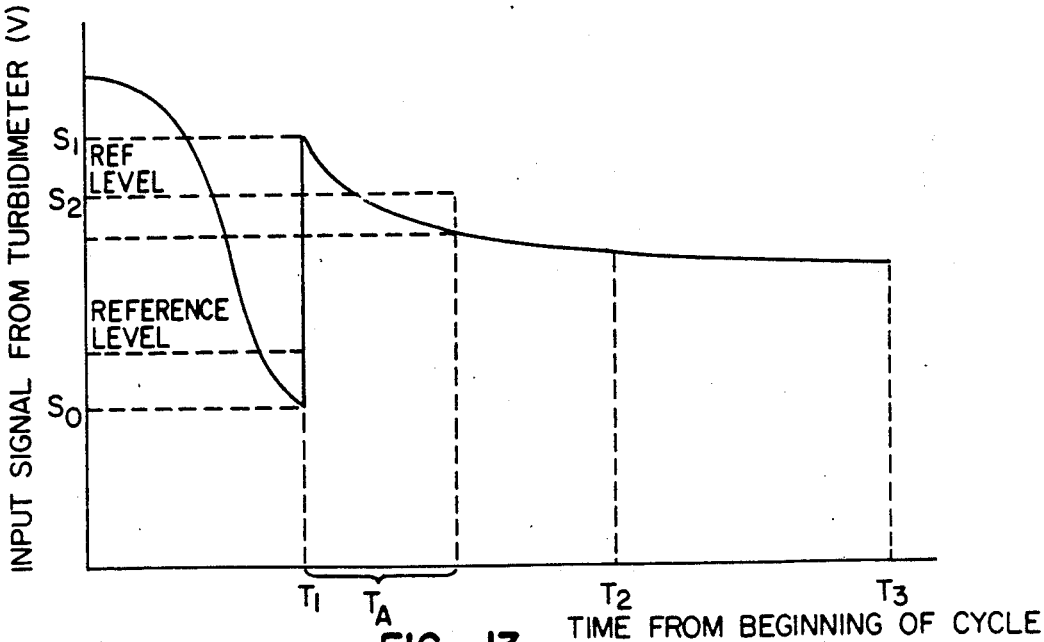
FIG. 13 is a graph which schematically shows how the output signal from the turbidity detecting circuit changes with respect to time when the control circuit of FIG. 11 is used according to the flow chart of FIG. 12.
Figure 12:
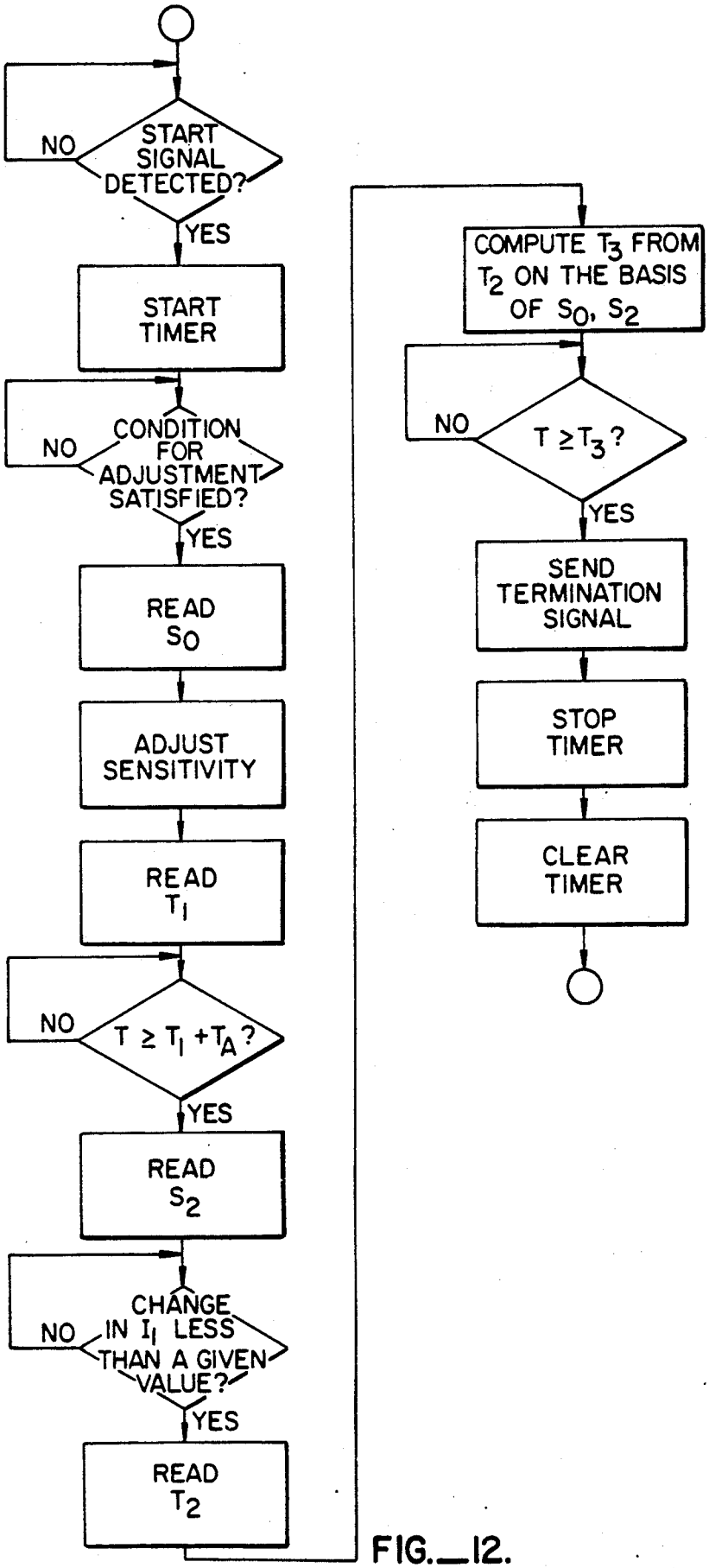
FIG. 12 is a flow chart for the control circuit of FIG. 11.

According to the embodiment shown in FIG. 11, the control circuit 61 includes a central processing unit (CPU) 62, read-only memory (ROM) means 63 for fixed data, random access memory (RAM) means 64 for temporary storage, a timer 65 and an input/output unit (I/O) 66. Numerals 16 and 23 indicate, as before, a turbidimeter and a sequence control means, respectively. FIG. 12 is a flow chart for the control circuit 61. In what follows, the control of washing and rinsing cycles is explained by way of this flow chart as well as FIG. 13 which shows schematically how the output signal from the turbidity detecting means 20 may typically change with respect to time. When a start signal from the sequence control means 23 indicating that a washing or rinsing cycle has started is detected, the timer 65 is started and input signals $I_1$ from the turbidimeter 16 are constantly checked to determine if a point has reached where the condition for adjusting its sensitivity is satisfied. When this point is reached, the input signal $I_1$ from the turbidimeter 16 and the timer reading T at this point ($S_0$ and $T_1$, respectively) are stored and the sensitivity is adjusted to a predetermined level as explained above. Let $S_1$ be the input signal $I_1$ after the adjustment as shown in FIG. 13.

Next, the timer reading T is monitored. When T becomes equal to or greater than $T_1+T_A$ ($T_A$ being a predetermined time interval), the input signal $I_1$ from the turbidimeter 16 at this time ($S_2$ as shown in FIG. 13) is also stored. Thereafter, the temporal rate of change in the input signal $I_1$ from the turbidimeter 16 is monitored as explained above. When this rate is found to have become less than a predetermined value, the timer reading T at this moment ($T_2$ as shown in FIG. 13) is stored. At this point, it is determined on the basis of the values of $S_0$ and $S_2$ as will be explained below whether a correction (for example, by three minutes) should be made on $T_2$ to define the end time $T_3$ of this washing or rinsing cycle. If no correction is found necessary, $T_3$ is set equal to $T_2$. Finally, the timer reading T is monitored to detect the moment when T becomes equal to or greater than $T_3$. When it does, a termination signal is transmitted to the sequence control means 23 indicating the end of the current washing or rinsing cycle. At the same time, the timer 65 is stopped and the timer data are cleared.

The reason for correcting $T_2$ to define a new value $T_3$ is explained below for the case of a washing cycle. Reference being made to FIG. 13, the input signal $I_1$ from the turbidimeter 16 drops at the beginning when the washing cycle is started ($T=0$) and turbidity of the cleaning water becomes larger. As explained above, the turbidimeter 16 is adjusted at $T_1$ so that the input signal therefrom changes from $S_0$ to $S_1$. Turbidity of the cleaning water becomes still larger as the washing operation continues but the temporal rate of change in the input signal $I_1$ gradually becomes smaller. When it becomes less than a predetermined value at $T_2$, the conventional control system would terminate the washing cycle at this moment. In the case of hard-to-clean articles, however, the small temporal rate of change in turbidity does not automatically mean that washing should be terminated then.

According to the present invention as described above, the input signal $S_0$ from the turbidimeter 16 with the original sensitivity level is stored and this makes it possible to estimate the amount of dirt contained in the articles being washed. Articles which are hard to clean may contribute much to the increase in turbidity in the beginning but their contribution may reach a substantially high level in the neighborhood of $T=T_1$, decreasing again as time further goes on. In other words, articles which are hard to clean contribute to the increase in turbidity according to a different time schedule compared to articles that are easily cleaned. The value $S_2$ obtained after waiting for a predetermined time duration $T_A$ serves to indicate whether hard-to-clean articles are contained. Since $S_1$ is fixed uniquely by the sensitivity adjustment, $S_2$ is an indicator of the change in turbidity. Accordingly, even if the moment identified by $T_2$ in FIG. 13 is detected relatively soon after $T_1+T_A$, but if $S_0$ is below a certain reference level, it can be concluded that there is much to be washed yet and a correction is made from $T_2$ to $T_3$ as explained above. Similarly, if $S_2$ is below a certain reference level, it is concluded that there are articles which are hard to clean and a different correction may be made on $T_2$. Furthermore, if both $S_0$ and $S_2$ are respectively below certain reference levels, a still other correction may be effected on $T_2$.

The method for correcting $T_2$ has been described above regarding a washing cycle but this can also be effected in a rinsing cycle when the temporal rate of change in turbidity is small by considering the values of $S_0$ and $S_2$ so that insufficient washing and rinsing can be avoided.

As mentioned above briefly, there are situations where rinsing must be effected more than once. An idea has been presented to provide a washing machine adapted to repeat a rinsing cycle up to three times, being comprised of a decision-making means regarding re-rinsing which computes the average turbidity value during the rinsing cycle from its initial and final values and compares this average value with a reference value. Such a washing machine, however, cannot effect rinsing appropriately, depending on how the reference value is selected.

Reference being made further again to FIG. 1, the turbidity detecting means 20 according to one embodiment of the present invention may include not only memory means for storing detected values outputted from the turbidimeter 16, etc. as explained before, but also a means for deciding whether re-rinsing should be effected or not by computing an average between an initial value stored in a memory means and the detected value when the termination of that rinsing cycle is determined. Its operation will be explained next by way of the flow chart of FIG. 14 and the graph of FIG. 7 which will now be considered to relate to a rinsing cycle.

After the motor 18 is switched on to start a (first) rinsing cycle at the point A (referring to FIG. 7), water begins to circulate through the circulation route 15. This uniformizes the concentration of the cleaning water throughout the route 15 so that the turbidity level detected by the turbidimeter 16 drops for a while as explained above. When the detected turbidity level stops dropping and begins to increase, this change in direction is detected. The turning point is identified by the point B in FIG. 7 and the turbidity level detected at this point B in time is stored as an initial value for subsequent use. After further rinsing, when the temporal rate of change in detected turbidity level is found to be less than a predetermined value, a saturation point is considered to have been reached and the turbidity detecting means 20 identifies it as the terminating point C for the cycle and stores the turbidity level at this point as the final value. Next, an average value is computed from the aforementioned initial and final values. If this average value is found to be smaller than a predetermined first reference value $V_{r1}$, it is concluded that no more rinsing is necessary and the system proceeds onto a next process such as draining. If it is found that the average is larger than the first reference value $V_{r1}$, on the other hand, it is concluded that re-rinsing is required and a second rinsing cycle is started.

Figure 14:
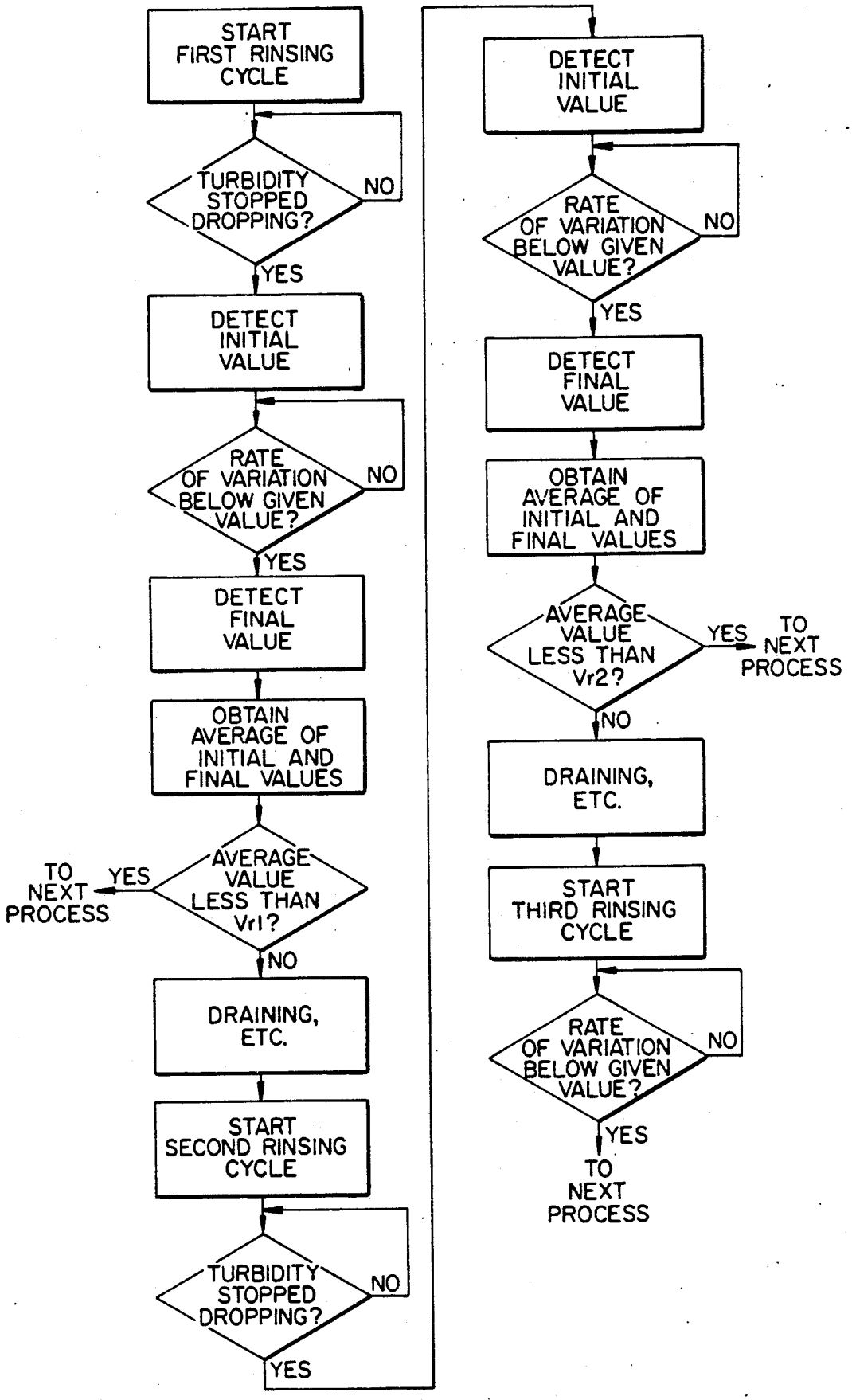
FIG. 14 is a flow chart of the routine for determining the rinsing procedure.

The second rinsing cycle proceeds similarly to the first rinsing cycle as shown in FIG. 14, effecting determination of a new initial value and a new final value. A new average value is computed similarly and compared with a predetermined second reference value $V_{r2}$ to determine whether a third rinsing cycle must be started. The third rinsing cycle proceeds similarly to the first and second rinsing cycles except that it is terminated when the temporal rate of change in detected turbidity level reaches a predetermined value.

If the first and second reference values are so set that $V_{r1}$ is greater than $V_{r2}$, there is a possibility of terminating the rinsing after one cycle even for articles requiring two cycles because $V_{r1}$ is large. There is also a possibility, because $V_{r2}$ is small, of effecting the third cycle of rinsing even if the average value after the second rinsing cycle is fairly small. If $V_{r1}=V_{r2}$ and they are both too high, rinsing is likely to be terminated too early. If $Vr_1=V_{r2}$ and they are both too low, on the other hand, excessive rinsing is likely to result. According to the present invention, they are set in such a way that $V_{r1}$ is smaller than $V_{r2}$ to avoid over-rinsing and under-rinsing.

The foregoing description of embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled int he art to best utilize the invention in various embodiments and with various modifications as are suited to the particular use contemplated. It is intended that the scope of the invention be defined by the claims appended hereto.

What is claimed is:

1. A washing machine, comprising:

a tank for storing cleaning water;

a pulsator disposed inside the tank for agitating the cleaning water;

a motor for driving the pulsator, which motor is in mechanical connection with the pulsator;

a turbidimeter for measuring turbidity of the cleaning water;

a motor-controlling means for alternately effecting a strong flow operation whereby the pulsator undergoes a first reciprocating motion and a flow operation whereby said pulsator undergoes a second reciprocating motion which is weaker than the first reciprocating motion; and a sensor-controlling means for causing the turbidimeter to measure cleaning water turbidity in a predetermined time period occurring between the beginning of the second reciprocating motion and the beginning of the first reciprocating motion.

2. The washing machine of claim 1 wherein said turbidimeter is inserted in a branching water route for circulating only a portion of washing water therethrough.

3. The washing machine as claimed in claim 1 wherein said motor-controlling means actuates the motor periodically to produce an intermittent flow.

4. A washing machine, comprising:

a turbidimeter for detecting turbidity of cleaning water inside said washing machine;

means for identifying a point in time when turbidity measured by said turbidimeter stops dropping after a motor for said washing machine is started at the beginning of a washing or rinsing cycle of said washing machine and storing as an initial value the level of turbidity detected by said turbidimeter at said point in time; and means for determining an end of said cycle by calculating when a temporal rate of the turbidity decreases lower than a predetermined rate and the difference between the initial value and the turbidity is smaller than a predetermined value.

5. The washing machine of claim 4 further comprising means for temporarily stopping washing operation of said washing machine and restarting said washing operation by automatically adjusting the sensitivity of said turbidimeter according to the turbidity level of said cleaning water at the time of restarting.

6. A washing machine adapted to operate in washing and rinsing cycles, said washing machine comprising a turbidimeter adapted to optically measure turbidity of cleaning water in said washing machine and to output a turbidity signal indicative of said measured turbidity, a cycle-controlling means for controlling operations of said washing and rinsing cycles on the basis of said turbidity signal, and a warning system adapted to activate a warning means if said measured turbidity is found to exceed a predetermined value and if said washing machine is in a rinsing cycle.

7. The washing machine of claim 6 wherein said warning system is further adapted to activate said warning means if said turbidity is found to be smaller than a predetermined minimum value.

8. A method of operating a washing machine having a turbidimeter for measuring turbidity of cleaning water in said washing machine, said method comprising the steps of adjusting sensitivity of said turbidimeter during a washing or rinsing cycle, measuring the signal levels from said turbidimeter before and a specific time period after said step of adjusting sensitivity, tentatively identifying a point in time for terminating said washing or rinsing cycle, and terminating said washing or rinsing cycle by effecting a delay from said point in time according to said measured signal levels.

9. The method of claim 8 wherein said step of tentatively identifying a point in time for terminating said washing or rinsing cycle includes comparing the temporal rate of change in turbidity of cleaning water measured by said turbidimeter with a predetermined reference value.

10. A method of controlling rinsing operation of a washing machine which comprises a turbidimeter for detecting turbidity of liquid therein, means for starting a rinsing cycle, means for ending said rinsing cycle by detecting temporal rate of change in turbidity by said turbidimeter and by comparing said rate with a predetermined minimum value, and means for determining at the end of a rinsing cycle whether another rinsing cycle is to be started after the end of said rinsing cycle by computing an average between an initial turbidity value detected by said turbidimeter at an initial point in time during said rinsing cycle and a final turbidity value detected by said turbidimeter at the end of said cycle and comparing said average with a predetermined reference value, said method comprising the step of operating said washing machine through a first rinsing cycle, using said determining means with a first reference value to decide whether or not to operate said washing machine through a second rinsing cycle, and using said determining means with a second reference value, if said washing machine is operated through a second rinsing cycle, to decide whether or not to operate said washing machine through a third rinsing cycle, said second reference value being larger than said first reference value.

11. A method of adjusting a predetermined detection level of a turbidimeter of a washing machine, which washing machine has a water circulating route with the turbidimeter inserted therein, wherein the turbidimeter includes a light-emitting element, a light-receiving element and a resistor attached either to said light-emitting element or to said light-receiving element, said method comprising the steps of:

using a reference unit structured similarly to said turbidimeter to determine a first resistance value $R_1$ and a second resistance value $R_2$ for obtaining a common water and air predetermined detection level when the water circulating route is filling with water and with air, respectively;

adjusting said resistor with said water circulating route filled with air to determine a third resistance value $R_3$ of said resistor such that said predetermined detection level of said turbidimeter is obtained from said turbidimeter; and varying the resistance of said resistor to $R_3-R_2+R_1$ whereby the fluctuations in said turbidimeter are corrected to the specifications according to said reference unit.

means for determining an end of said cycle by calculating when a temporal rate of the turbidity decreases lower than a predetermined rate and the difference between the initial value and the turbidity is smaller than a predetermined value.

12. A method of operating a washing machine having a turbidimeter for measuring turbidity of cleaning water in said washing machine, said method comprising the steps of:

continuously monitoring the temporal rate of change in turbidity of said cleaning water;

identifying a point in time when the turbidity level measured by said turbidimeter stops dropping after a washing or rinsing cycle of said washing machine is started;

storing as an initial value the turbidity level measured by said turbidimeter at said point in time; and terminating said cycle when a temporal rate of the turbidity decreases lower than a predetermined rate and the difference between the initial value and the turbidity is smaller than a predetermined value.

13. The method as claimed in claim 12, further comprising selecting a subsequent process when the difference between said initial value and turbidity measured by said turbidimeter is larger than the predetermined value at the end of said cycle.

* * * * *